United States Patent [19]

Carstens

[11] Patent Number: 4,582,195

[45] Date of Patent: Apr. 15, 1986

[54] DISPLAY UNIT MADE OUT OF PAPERBOARD OR CORRUGATED PAPERBOARD

[75] Inventor: Bernt Carstens, Neustadt, Fed. Rep. of Germany

[73] Assignee: Johannes Carstens GmbH & Co., Neustadt, Fed. Rep. of Germany

[21] Appl. No.: 677,212

[22] Filed: Dec. 3, 1984

[30] Foreign Application Priority Data

Dec. 2, 1983 [DE] Fed. Rep. of Germany ..... 3343741

[51] Int. Cl.[4] ..... B65D 5/52

[52] U.S. Cl. ..... 206/44 R; 206/45.14; 248/174

[58] Field of Search ..... 206/44 R, 45.14, 45.19, 206/427, 437, 497; 248/146, 152, 174; 211/133, 149, 186

[56] References Cited

U.S. PATENT DOCUMENTS

| | | | |
|---|---|---|---|
| 2,229,257 | 1/1941 | Reaume | 248/174 |
| 2,825,519 | 3/1958 | Potts et al. | 206/44 R |
| 3,089,632 | 5/1963 | Bartolucci | 248/174 |
| 3,464,569 | 9/1969 | Downing | 248/174 |
| 3,918,576 | 11/1975 | Taub | 206/44 R |

FOREIGN PATENT DOCUMENTS

| | | | |
|---|---|---|---|
| 1254983 | 1/1961 | France | 248/174 |
| 1312374 | 4/1973 | United Kingdom | 248/174 |

*Primary Examiner*—Joseph Man-Fu Moy

*Assistant Examiner*—David T. Fidei

*Attorney, Agent, or Firm*—Toren, McGeady, Stanger, Goldberg & Kiel

[57] ABSTRACT

A display unit for merchandise which is stored standing inside the unit strapped between a base tray and a lid tray, capable of being stored, transported and offered for sale via the topside, comprised of paperboard but, folded and glued in such a fashion as to form a block-shaped case. The case has a smooth lower section in which the merchandise can be stored with little lateral play between the side walls and the base tray. The side edges each display two v-shaped notches so that in a first section the side walls can be folded inwards and in a second section above said first section the side walls can be folded outwards approximately horizontally and a top section with vertical sides leading on from the second section.

Plastic holders with fingers pointing inwards and a protective surface pointing downwards are slotted through an aperture near the folding line between the second section and the top section. In the first section where the fold slopes inwards, there are two lugs cut, respectively, below the protective surface. A rubber band is hooked into each of these lugs, led behind the protective surface and up along the outside surface of the top section where it is hooked onto a retaining tongue of the plastic holder. The lower edge of the lid terminates on a level with the inward fold of the first section.

7 Claims, 1 Drawing Figure

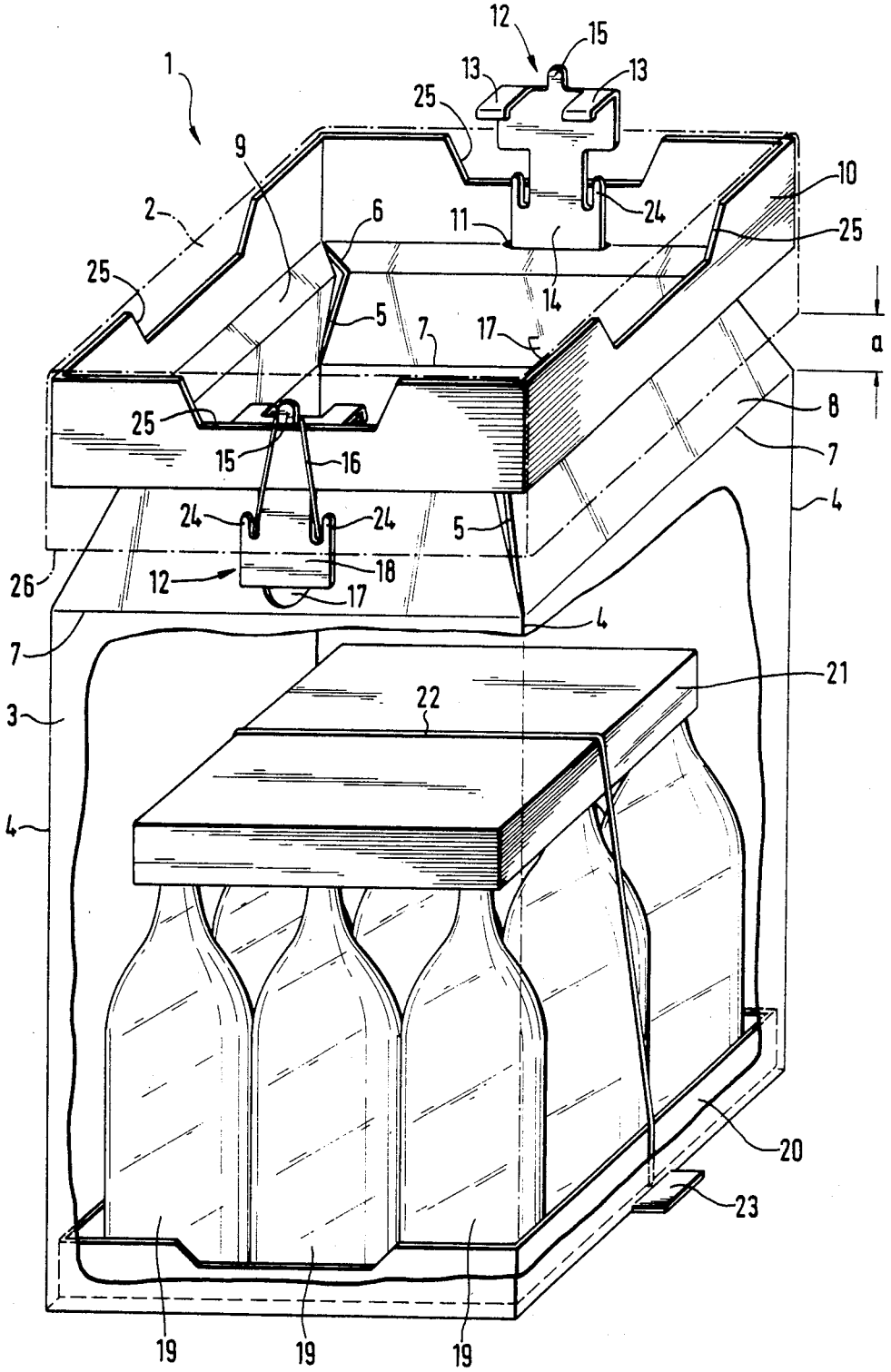
1
2
3
4
5
6
7
8
9
10
11
12
13
14
15
16
17
18
19
20
21
22
23
24
25
26
a

DISPLAY UNIT MADE OUT OF PAPERBOARD OR CORRUGATED PAPERBOARD

SUMMARY OF THE INVENTION

The invention concerns a display unit made out of paperboard or corrugated paperboard, cut, folded and glued in such a fashion as to form a block-shaped case with a separate lid for merchandise which is packed within the case strapped between a base tray and a lid tray, capable of being stored, transported and offered for sale via the topside of the case.

Display units which are designed for the storage, transport and subsequent display and sale of goods are generally known and in common use. The German Utility Model No. 790 1841, for example, shows a floor display with a tube-shaped base made out of folded material and a container connected to the top edge. During transport the foot and, if necessary, the container can be folded flat. To assemble, the base is unfolded to form a tube. At the same time pressure is applied to the material situated between three parallel folding lines, whereby the walls fold inwards and rest against each other thus giving the base a stabilising radial flange. A rubber band can be used to assist the folding-out operation by pulling the walls inwards.

Display units are employed primarily to attract the attention of customers in a store to such goods which are not on sale on the usual shelves but in a special sales unit, above all near cash registers. These display units are placed on their final point of sales by the retailer, the transport packaging is removed and the unit is assembled, where necessary. The goods then have to be arranged in such a fashion that they are ready for selling, if the manufacturer has not already allowed for this in the design of the unit.

It is of considerable importance that not only the removal and disposal of the packaging material is possible in a short space of time but that the display unit takes up very little floor room, otherwise the retailer could remove the display units together with the goods and place them in some remote corner of the store where the goods naturally no longer attract attention and sales suffer. Another danger is that the retailer takes the goods out of the display unit and places them on one of the normal sales shelves where they are likewise less conspicuous and do not stimulate sales.

A further important factor is that the weight of the display unit, including the transport packaging, is not so heavy that female sales staff cannot carry the complete unit to the point of sales and on the other side that the merchandise is positioned at the correct selling height.

The first object of the invention is to describe a display unit, which is not only simple to produce and affords protection to the merchandise during storage and transport but can also be stacked on top of each other without additional support material, can be unpacked out of the transport packaging with ease and assembled for selling with one action.

This task is solved by the case having a smooth lower section in which the merchandise can be stored with little lateral play between the side walls and the base tray, that the corners of the case have two v-shaped notches thus allowing the walls of a first section to be folded inwards and those of a second section leading on from said first section to be folded out approximately horizontally, that a top section with vertical walls leads on from the second section, that the front and back walls of the top section each possess a plastic holder with retaining fingers pointing inwards and a protective surface pointing downwards slotted into an aperture in the folding line between the second section and the top section, that in the first section, folded inwards, a lug is cut under the protective surface in which a rubber band is hooked and then led behind the protective surface over and up the outside surface of the top section to be hooked onto a notch in the plastic holder, that the lower edge of the lid terminates at the level of the inward-folded first section and that the lid rests on a lid tray during transport and storage.

The advantages resulting therefrom are that the display unit is essentially a block-shaped unit with smooth sides capable of being stacked compactly, that the dimensions can be easily altered to accomodate the merchandise in question, that, following removal of the lid, the strapping holding the merchandise between the base tray and lid tray can be gripped with one hand and pulled together with the merchandise up and out of the case, that the upward movement past the inward-folded sections, rendered elastic by the rubber bands, allows these sections to close in once more after the base tray has passed this constriction, that the retaining fingers of the plastic holder engage in the base tray thus preventing the complete removal of the merchandise still strapped between the base tray and the lid tray and that the base tray, together with the merchandise standing in it, rests safely on the second section, folded outwards.

The display unit is also constructed in such a fashion that during storage and transport, the lid rests on the lid tray of the merchandise inside the unit. In this way numerous units can be stacked on top of each other, the weight being supported by the merchandise itself and not by the paperboard. This is particularly advantageous when the merchandise is, for example, bottles which can support far more weight than the paperboard of the case.

Pursuant to the invention, the case and lid are protected by shrink-wrapping during storage and transport. The lower edge of the lid serves as a guideline for the knife normally used by sales staff in removing such wrapping. Since this lower edge is in the vicinity of the case section which is folded inwards, the case itself will not be damaged during the cutting operation. At the same time the protective surfaces of the plastic holders prevent the rubber bands being damaged. The protective surfaces have an additional function inasmuch as they also protect the paper lugs in the section folded inwards from being bent or torn out by the rubber bands under tension.

BRIEF DESCRIPTION OF THE DRAWING

The drawing shows, in perspective, a display unit made out of paper board but, folded and glued in such a fashion as to form a block-shaped case with a separate lid.

DETAILED DESCRIPTION OF THE INVENTION

The display 1 possess a smooth lower section 3, illustrated in a transparent fashion so as to show the arrangement of the merchandise within the unit.

During storage and transport the top side of the display unit 1 is closed with a lid 2, illustrated with a dotted line so as to show the peculiarities in the case design.

The lower section 3 of the display unit 1 is block-shaped with smooth walls. Two v-shaped notches 5, 6 are situated next to each other on the edges 4 above the horizontal folded line 7. These notches 5, 6 enable the walls of the first section 8 to be folded inwards, obliquely, and of a second section 9 to be folded approximately horizontally outwards. This second section 9 forms a table-like edge around the unit on which the goods can be placed ready for selling. A top section 10 leads on from the second section 9, its cross-section and vertical surfaces corresponding to the lower section 3.

On both the front and rear walls of the top section 10, a plastic holder 12 is discernible which is slotted through an aperture 11 in the folding line between the second section 9 and the top section 10. The plastic holders 12 possess fingers 13 pointing inwards and a retainer 15. On the lower side a protective surface 18 is visible. The plastic holder 12 is itself held by means of a rubber band 16 which is hooked onto the retaining tongue 15 led downwards along the outside of the top section 10 and behind the protective surface 18 to be hooked onto a lug 17.

This lug 17 is cut into the first inward-folded section 8 of the side walls, whereby the cutting line has been selected so as to release the lower side of the lug 17 when folding the first section 8 inwards, thus facilitating the hooking in of the rubber band 16.

As illustrated in the drawing, the protective surface 18 of the plastic holder 12 is so designed that it not only covers up the rubber band 16 but, at the same time, holds the lug 17 so that the latter cannot be deformed or ripped off by the tensioned rubber band 16 following long periods of storage.

In the transparent illustration of the lower section 3 of the display unit 1 a merchandise is visible, in this case, wine bottles 19. These bottles 19 stand in a base tray 20. On top of the merchandise is a lid tray 21. The base tray 20 and the lid tray 21 are so designed that the bottles are securely held by the strapping 22.

For the sake of lucidity, the drawing does not show that a second strapped unit of bottles 19 is positioned on top of the strapped unit illustrated. The height of the display unit 1 has been designed so that the lid tray of the bottle unit not illustrated protrudes slightly above the top section 10 whereby the separate lid 2 rests on the top lid tray. In this way the weight of additional display units stacked on top of each other during storage and transport is carried by the bottles. Glass bottles possess more strength than the paperboard of the display unit. The base tray 20 is held with little lateral play within the display unit 1. The cross-section of the lid tray 21 has been designed so that it passes with little lateral play through the constriction formed by the inward-folded walls of the first two sections 8, 9.

In order to position the bottles 19 ready for selling, the salesman takes hold of the strapping 22 as instructed by the corresponding imprint on the lid tray 21 and pulls up the base tray 20, the lid tray 21 and the bottles 19 packed within. The inward-folded sections 8, 9 of the outside walls are pushed out and the rubber bands 16 tensioned. The retaining fingers 13 lock onto the top edge of the base tray 20 and thus prevent the bottle unit 19 being pulled completely out of the display unit 1.

As soon as the bottle unit 19 is lowered the first and second sections 8, 9 close in once more due to the tension of the rubber bands 16 so that the base tray 20 rests securely on the almost horizontal, outward-folded section 9. After cutting through the strapping 22 the lid tray 21 can be removed and the bottles 19 rendered ready for selling.

Angled, u-shaped cutouts 25 in the vicinity of the top section 10 ensure that the plastic holders 12 are lower than the lid 2 and thus cannot bore holes through said lid 2. Furthermore these u-shaped cutouts 25 enable the removal of the empty base tray 20 when the bottles 19 have been sold.

As further illustrated in the drawing, there is a clearance between the folding line 7 and the lower edge 26 of the lid 2. This clearance has been designed to allow for the shrinkwrapping used for storage and transport to be cut off without the paperboard, out of which the display unit 1 is made, being damaged by the knife.

It is further noticeable that the protective surfaces 18 of the plastic holders 12 protect the rubber bands 16 also from damage from the knife. In the protective surfaces 18 two notches 24 are visible. Should the merchandise be pulled up by means of the strapping 22 too vigorously, the plastic holders 12 would tend to overstretch the rubber bands 16 by means of the retaining fingers 13; in an extreme instance, it could be pulled out of the aperture 11 completely. This is prevented by the rubber band 16 automatically hooking into the notches 24 whereby it becomes shortened and tightened around the top section 10 and thus has its original degree of extensibility reduced.

In order to prevent the lightweight display unit 1 also being pulled off the ground whilst pulling the lower bottle unit 19 out of the display unit 1, two side tabs 23 have been incorporated in the base on which the salesman can place his feet.

During the development of the display unit 1 it was attempted to achieve the tensioned fold between the first two sections 8, 9 by utilising a rubber band running round the unit through the cleft. This solution, however, has the disadvantage that the edges of the base tray 20 became tangled up in the rubber band whilst being pulled up. In the case of it being possible to use a base tray with chamfered edges, this solution would be feasible.

I claim:

1. Display units made out of paperboard cut, folded and glued in such a fashion as to form a block-shaped case with a separate lid for merchandise which is packed within the case strapped between a base tray and a lid tray, capable of being stored, transported and offered for sale through the top side of the case by virtue of the case having a smooth lower section, the merchandise being packed with little lateral play between the side walls and the base tray, there being two v-shaped notches directly opposed in the edges of each side wall, so that in a first section the side walls can be folded inwards and in a second section above said first section folded outwards approximately horizontally, there being a top section with vertical walls leading on from said second section, there being one plastic holder on the front and rear side of said top section, respectively, with retaining fingers pointing inwards and a protective surface pointing downwards slotted through an aperture near the folding line between said second section and said top section, there being in said first inward sloping section under each protective surface a lug, there being in said lug a rubber band which is led behind said protective surface up along the outside surface of the top section and hooked onto a retaining tongue of the plastic holder, that the lower edge of the lid terminates on a level with the inward fold of the said first section, that during storage said lid sits directly on a lid tray.

2. The display unit as set forth in claim 1, characterised by a shrinkwrapping around the case and lid during storage and transport.

3. The display unit as set forth in claim 1, characterised by the fact that the cross-section of the two inward folds corresponds approximately to the cross-section of a lid tray.

4. The display unit as set forth in claim 1, characterised by the fact that on the top edge of the top section and the top edge of the base tray there are angled, u-shaped cutouts.

5. The display unit as set forth in claim 4, characterised by the fact that the height of the material within the area of the u-shaped cutouts in the top section and the base tray is approximately equal.

6. The display unit as set forth in claim 1, characterised by the fact that a tab protrudes from the projection of the case base.

7. The display unit as set forth in claim 1, characterised by the fact that there are notches in the protective surface of each plastic holder near the rubber band.

* * * * *